United States Patent [19]

DeLucia

[11] Patent Number: 4,962,818

[45] Date of Patent: Oct. 16, 1990

[54] DOWNHOLE MOTOR WITH AN ENLARGED CONNECTING ROD HOUSING

[75] Inventor: Frank DeLucia, Aberdeen, Scotland

[73] Assignee: Smith International, Inc., Houston, Tex.

[21] Appl. No.: 500,321

[22] Filed: Mar. 28, 1990

Related U.S. Application Data

[63] Continuation of Ser. No. 380,426, Jul. 17, 1989, Pat. No. 4,932,482.

[51] Int. Cl.[5] ..... E21B 4/02; F03B 3/04; F03B 13/02

[52] U.S. Cl. ..... 175/75; 175/61; 175/107; 418/48

[58] Field of Search ..... 175/107, 75, 104, 101, 175/92; 418/48

[56] References Cited

U.S. PATENT DOCUMENTS

| | | | |
|---|---|---|---|
| 1,892,217 | 12/1932 | Moineau | 74/458 |
| 2,250,912 | 7/1941 | Hudson et al. | 175/99 |
| 2,898,087 | 8/1959 | Clark | 175/99 |
| 3,260,069 | 7/1966 | Neilson et al. | 424/16 |
| 3,260,318 | 7/1966 | Neilson et al. | 175/75 |
| 3,999,901 | 12/1976 | Tschirky | 175/107 |
| 4,067,404 | 1/1978 | Crase | 175/75 |
| 4,667,751 | 5/1987 | Geczy | 175/61 |

*Primary Examiner*—Stephen J. Novosad
*Attorney, Agent, or Firm*—Robert G. Upton

[57] ABSTRACT

A bottom hole assembly is disclosed consisting of a downhole motor having a drill bit connected to its lower end and a bent sub attached to its upper end. The downhole motor includes a motor housing, a connecting rod housing and a bearing housing. The connecting rod housing has a bend angle formed on the housing, which is enlarged to enable the connecting rod to be tilted at a larger angle than otherwise possible. The enlarged connecting rod housing also functions as a near bit stabilizer.

3 Claims, 2 Drawing Sheets

DOWNHOLE MOTOR WITH AN ENLARGED CONNECTING ROD HOUSING

CROSS-REFERENCE TO RELATED APPLICATIONS

This application is a continuation of application Ser. No. 380,426, filed July 17, 1989 entitled Downhole Motor With An Enlarged Connecting Rod Housing and now U.S. Pat. No. 4,932,482.

BACKGROUND OF THE INVENTION

1. FIELD OF THE INVENTION

The present invention relates generally to downhole drilling motors and more particularly to modifications in drilling motor construction which enable such motors to function more efficiently in bottom hole assemblies.

2. DESCRIPTION OF THE PRIOR ART

The use of motors in bore hole drilling, especially in drilling for oil and gas, has been a standard procedure in the art. Such motors are employed to rotate drill bits for boring in the earth for forming bore holes. We refer to such motors as in-hole motors when designed to be run at the end of a drill string and adjacent to the drill bit. Other components such as stabilizers, MWD sensors and pulsers are utilized with the motor and bit to form bottom hole assemblies.

There are two types of downhole motors, the hydrodynamic type known as the turbodrill downhole motor, or the positive displacement type known as the progressive cavity downhole motor.

The most common type of downhole motor is the progressive cavity type composed of a helicoidal rotor and a complimentary helicoidal stator. Such construction was first taught by Rene Moineau in U.S. Pat. No. 1,892,217 in 1932. It wasn't until 1941 when such a motor was adapted for downhole use. Such a use was taught in U.S. Pat. No. 2,250,912.

A precursor to Assignees downhole motor, which has come to be known as the Dyna-Drill motor is shown in Wallace Clark's U.S. Pat. No. 2,898,087.

Since the rotor of such a motor rotates in an eccentric manner, it is necessary to convert this motion into a true rotation about a fixed axis so that power may be imparted to the drill bit. This can be accomplished by connecting a solid spring type rod between the end of the rotor and output shaft to permit the shaft to rotate about a true axis or by connecting the end of the rotor to a connecting rod by means of a universal joint and connection rod to the output shaft by means of a second universal joint to permit the shaft to rotate about the true axis. A more sophisticated type of universal joint known as the lobed coupling is described in Assignee's U.S. Pat. No. 3,260,069.

It was then found that it was possible to take advantage of the fact that a solid spring type rod or universal joint connection must be present between the turbodrill or the positive displacement type motor and the output shaft and that a clearance space must exist therearound in order to fabricate a bend on the motor housing at this point rather than at the top of the motor. With the arrangement, which was described in U.S. Pat. No. 3,260,318, the location of the bend in the drilling apparatus can be quite close to the bit to provide a larger side load on the bit and to enable one to obtain greater control in orienting the bit.

It was then found that the bend angle practically permissible for a single deviating unit was very limited, in the range of 1 degree to 1.25 degrees. In order to obtain a drilling assembly with a greater degree of bend, a combination of bent sub and bent housing was used. Various types of these assemblies are shown in Assignee's U.S. Pat. No. 4,067,404.

Initially, such bottom hole assemblies were used in an orienting mode only, i.e. the drill string and motor housing was stationary in the hole but oriented in the direction one wished to deviate. After the desired deviation was achieved, the assembly was removed and regular rotary drilling methods were utilized.

However, Assignee later discovered that with strategic location of stabilizers, the drill string with the bent motor housings with or without the bent subs, could be rotated to drill substantially in the straight direction, or the normal orienting mode could be utilized to change angle or make corrections in the bit travel. Such a system, known as the steerable system, is shown in Assignee's U.S. Pat. No. 4,667,751. In such a system a stabilizer is located near the bit.

Although such assemblies are working quite satisfactory, there exists a present day demand for more build rate, i.e. the degree deviation per one hundred feet of drilling. In a single bent housing assembly present day assemblies have still been limited to 1 degree to 1.25 degrees, which would give a build rate of 2 to 6 degrees per 100 feet. In a double bend assembly utilizing a 1.25 degree bent housing and a 1 to 2 degree bent sub, the build rate is about 12 degrees per 100 feet.

A simple solution would be to increase the angle of the bent housing. However, this is not practically possible because of the lack of clearance within the motor connecting rod housing. This increased bending would cause the universal joint to interfere with the housing and damage the motor.

It was also realized that the near bit stabilizer would not operate efficiently with increased bent angles since such a stabilizer would negate build rate.

SUMMARY OF THE INVENTION

The present invention obviates the above-mentioned problems by providing a bent housing assembly that has a larger bend angle to satisfy the demands for larger build rates. This is accomplished by enlarging the connecting rod housing with respect to the rest of the motor housing. This enlarged compartment accommodates the increased angle of the universal joint while still maintaining the housing wall thickness and clearance between the parts. At the same time, the oversized connecting rod housing section can also function as a near bit stabilizer thereby eliminating the need for such a component in the assembly, while still not affecting the build rate.

It has also been found that the outside diameter of the bent connecting rod housing section has greater control on the side loads of the bit, in addition to increasing such loads.

By enlarging the connecting rod housing section, the bent angle at the universal joint is capable of being increased above 1.25 degrees, thereby increasing the build rate of a single bend assembly to 8 to 12 degrees per 100 feet, and a double bend assembly 18 to 20 degrees per 100 feet.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
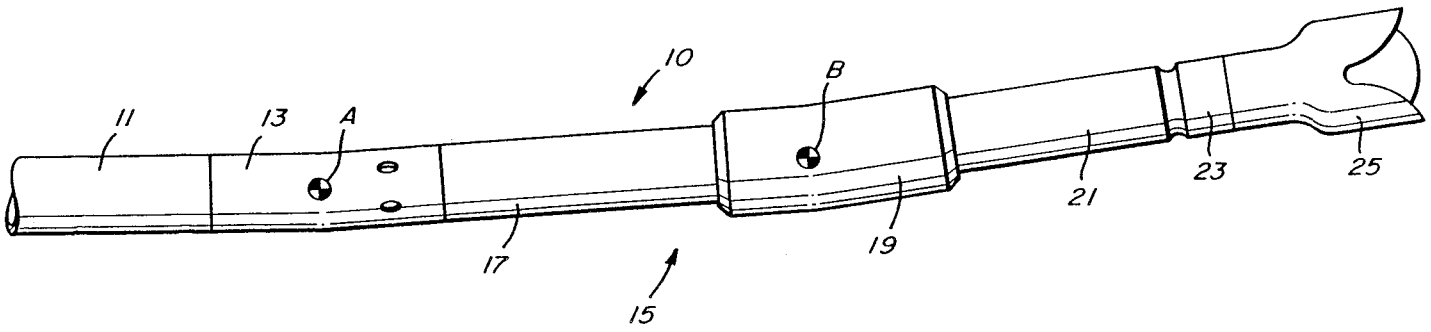
FIG. 1 is a side elevational view of the bottom hole assembly utilizing the downhole motor having the enlarged connecting rod housing section in accordance with the present invention.

FIG. 1 illustrates the lower end of bottom-hole assembly (BHA) generally indicated by arrow 10. The top end of the assembly 10 may include one or more stabilizers and a plurality of other components such as MWD sensors and pulsers, which in turn, is connected to the drill string in the conventional manner. The illustrated portion of the bottom-hole assembly 10 includes a tubular element 11 which could be a drill collar, drill pipe or other BHA component. This element 11 is threadedly connected to a bent sub 13 which is located directly above a downhole motor 15 and threadedly connected thereto. The downhole motor 15 comprises a motor housing section 17, a connecting rod housing section 19, and a bearing housing section 21. The motor housing section 17 preferably houses the rotor and stator section of a progressive cavity hydraulic motor, although the section 17 could also house a plurality of turbine sections of a turbodrill motor. In either case, the motor section would include a rotor which is adapted to be connected to a universal joint or flexible rod coupling (not shown in FIG. 1) which is housed in the connecting rod housing section 19. As will be described later, the coupling is then adapted to be connected to an output shaft located in the bearing housing section 21. The lower end of the output shaft terminates in a threaded box connection 23, which in turn, is threadedly connected to a drill bit 25. Although the drill bit 25 illustrated is a rolling cone bit, a diamond bit or polycrystalline diamond compact type drag bit could also be utilized.

Although other bend angles at point "A" and "B" can be utilized, the bent sub 13 illustrated has a 1.5 degree bend angle built into its construction at point A to supply an additional angle change.

The outside diameters of tubular element 11, bent sub 13, motor housing section 17 and bearing housing section 21 is 6.5 inches which is one of the common sizes utilized. Other sizes can be from 1.75 inches to 12 inches. In the past the conventional bent housings of the downhole motor 15 also had an outside diameter which was identical to the motor housing section 17.

In the preferred embodiment, the connecting rod housing section 19 has been enlarged with respect to the motor housing section 17 to have an outside diameter of 8.25 inches. If other size motor housing sections 17 are utilized, proportionally larger connecting rod housing sections 19 would be correspondingly used. The connecting rod housing section 19 has a bend angle of 2.5 degrees located at bend angle point B although other corresponding bend angles can be utilized.

It should also be noted that the exterior of the housing section 19 has a smooth continuous surface which differs from conventional stabilizers that have ribs or other projections protruding therefrom.

As is common with such assemblies, the outside diameter of the drill bit 25 is 9.875 inches, although other sizes of bits may be utilized.

Figure 2:
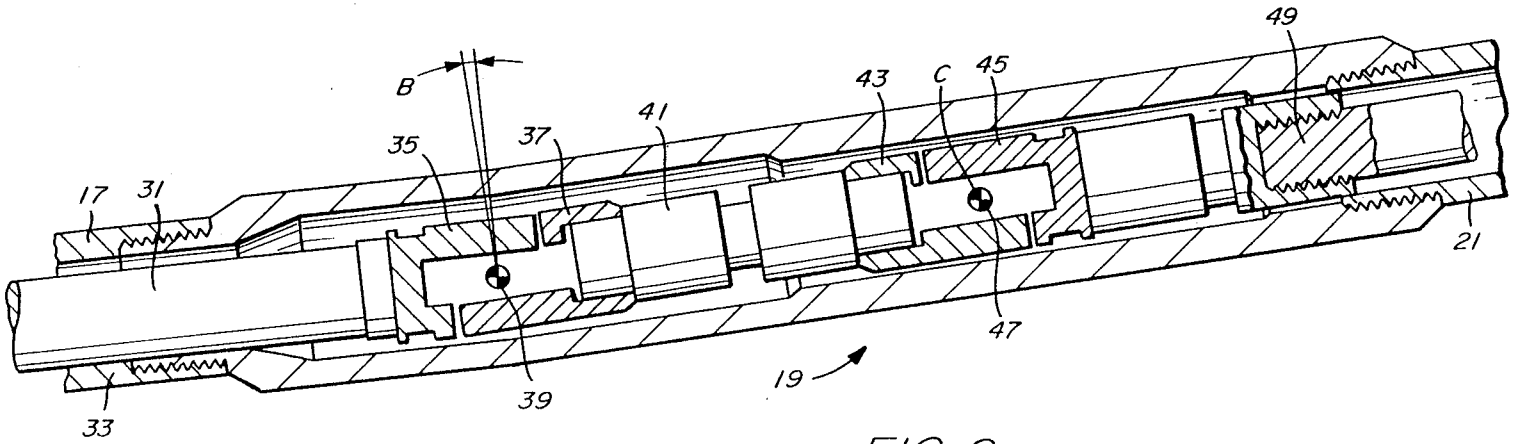
FIG. 2 is a sectional view of the enlarged connecting rod housing section of the present invention and FIG. 3 is a graph representing the vertical plane of an actual run of the bottom hole assembly of the present invention.

FIG. 2, which illustrates the interior of the connecting rod housing section 19, illustrates a lower end of the motor rotor 31 extending from the lower end 33 of the motor housing section 17. The motor rotor 31 is illustrated as being eccentrically positioned within the motor housing section 17. The lower end of the motor rotor 31 is connected to a universal joint 35 which is angularly and pivotally interconnected to a universal joint 37 through a ball pivot point 39 which forms the bend angle point B. The universal joint 37 is attached to a connecting rod 41, which in turn, is connected to a second universal joint 43. A second universal joint 45 is interconnected to the universal joint 43 through a ball pivot point 47 which could also form a bend angle C if required for additional angle change.

The lower end of the second universal joint 45 is connected to an output shaft 49 which extends through the bearing housing section 21 to be connected to the drill bit 25.

As stated previously, the outside diameter of the connecting rod housing section 19 is 8.25 inches. It is also noted that the wall thickness of the connecting rod housing section 19 is approximately similar to the wall thickness of the motor housing section 17. However, by enlarging the diameter of the outer wall of the connecting rod housing section 19, a larger compartment is provided within the interior of the same to provide a greater clearance for the conventionally sized universal joints or solid spring type rod housed within. This enables the universal joint or solid spring type rod to have a larger tilt angle than previously possible without interference of the components. For this reason, the connecting rod housing section 19 can be bent to have a bend angle greater than before. As mentioned previously, three problems were solved by redesigning one bottom-hole assembly component, the connecting rod housing section 19. The outside diameter of the housing required was enlarged to permit the hole wall contact for angle change. This larger outside diameter permitted a larger interior diameter for the universal joint or solid spring type rod to flex in a bend angle greater than before.

As illustrated, the downhole motor housing was fitted with a 1.5 degree bent sub at bend angle point A.

Two different build assemblies were utilized to test the inventive concept.

ASSEMBLY I

Diamond sidetrack bit
6-1-2" Medium speed motor
with 2½ deg. bent housing
1½ deg. bent sub
6¾" modified MWD
5" heavy weight drill pipe
6¼" drill collars
4½" aluminum drill pipe
Drilling hours: 73.7 hours
Footage: 199 ft.
Build rate: 19.4 deg./100 ft.
WOB range: 10000–48000 lbs.
WOB average: 40000 lbs.

ASSEMBLY II

IADC 6-1-7 roller bit
6½" slow speed motor
with 2½ deg. bent housing
1½ deg. bent sub
6¾" modified MWD
5" heavy weight drill pipe
6¼" drill collars
4½" aluminum drill pipe
Drilling hours: 24 hours
Footage: 271 ft.
Bit speed: 160 rpm
Build rate: 19.4 deg./100 ft.
WOB range: 10000–30000 lbs.
WOB average: 20000 lbs.

Differences between assemblies are that Assembly I used a diamond sidetrack bit in conjunction with a medium speed downhole motor, and Assembly II used a roller bit in conjunction with a slow speed downhole motor.

During testing, build Assembly I reached an equilibrium build rate in a short distance of 82 feet. The average build rate for both assemblies was 19.4 degrees per 100 feet.

Figure 3:
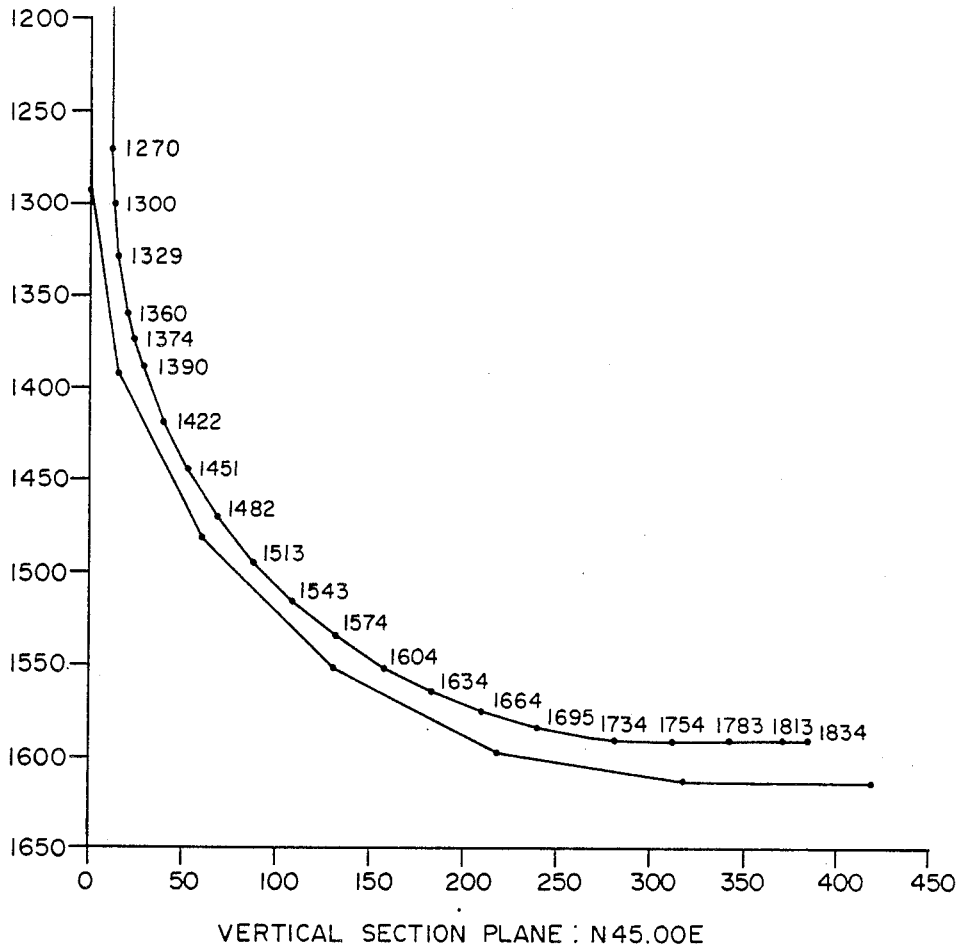

FIG. 3 illustrates the travel of build Assembly I which simulated a standard kickoff. It was drilled with a straight hole rotary assembly to kick off point (1292 feet). The build assembly drilled in a sliding mode for the entire build section and it was not necessary to rotate even though it is possible. Flow rate was 350 gallons per minute with resultant bit speed of 392 rpm. Weight on bit was slowly increased to 10,000 pounds and increasing thereafter to 48,000 pounds.

Build Assembly II was tested to solve rate of penetration limitations. A slow speed downhole motor with button bits (IADC code 6-1-7) allowed penetration rates in excess of 400% faster than Assembly I. Bit speed was 160 rpm. Weight on bit was 20,000–30,000 pounds.

Although the two examples illustrated runs in the sliding mode, it should be noted that the single, double or triple bend assembly could also be rotated in the steerable mode. Stabilizers, both concentric or eccentric, could also be used with such bottom hole assemblies above the motor assembly similar to that shown in Assignees U.S. Pat. No. 4,667,751. The only difference is that the near bit stabilizer is not necessary because of the inclusion of the enlarged connecting rod housing section 19 in small holes. In the larger diameter holes the near bit stabilizer is required to combat natural weight tendencies of the bottom-hole assembly.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated.

What is claimed is:

1. A downhole motor of the tubular type comprising:
- a first elongated motor housing of a predetermined outside diameter;
- a second elongated motor housing located adjacent to the first motor housing;
- an angular bend formed on the second motor housing at a predetermined location; and
- the second motor housing have an enlarged housing section of a predetermined outside diameter larger than the outside diameter of the first motor housing, said enlarged housing section having a smooth continuous annular exterior surface.

2. A bottom-hole assembly comprising a downhole motor of the tubular type and a drill bit rotatively interconnected to the lower end of the motor, the downhole motor comprising:
- a first elongated motor housing of a predetermined outside diameter;
- a second elongated motor housing located adjacent to the first motor housing;
- an angular bend formed on the second motor housing at a predetermined location; and
- the second housing having an enlarged housing section of a predetermined outside diameter larger than the outside diameter of the first motor housing, said enlarged housing section having a smooth continuous annular exterior surface.

3. A bottom hole assembly comprising a downhole motor of the tubular type, a drill bit rotatively interconnected to the lower end of the motor, and a bent sub interconnected to the upper end of the motor, the bent sub comprising an elongated housing having an angular bend formed thereon, the downhole motor comprising:
- a first elongated motor housing of a predetermined outside diameter;
- a second elongated motor housing located adjacent to the first housing;
- an angular bend formed on the second motor housing at a predetermined location; and
- the second motor housing having an enlarged housing section of a predetermined outside diameter larger than the outside diameter of the first motor housing, said enlarged housing section having a smooth continuous annular exterior surface.

* * * * *